US006913082B2

(12) United States Patent
McGlothen et al.

(10) Patent No.: US 6,913,082 B2
(45) Date of Patent: Jul. 5, 2005

(54) REDUCED DEBRIS MILLED MULTILATERAL WINDOW

(75) Inventors: Jody R. McGlothen, Waxahachie, TX (US); Joseph D. Parlin, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 162 days.

(21) Appl. No.: 10/376,804

(22) Filed: Feb. 28, 2003

(65) Prior Publication Data

US 2004/0168807 A1 Sep. 2, 2004

(51) Int. Cl.[7] ..... E21B 17/08

(52) U.S. Cl. ..... 166/313; 166/242.1; 166/255.2; 138/177

(58) Field of Search ..... 166/313, 50, 117.5, 166/242.1, 242.5, 255.2, 255.3; 138/177, 178

(56) References Cited

U.S. PATENT DOCUMENTS 4,415,205 A * 11/1983 Rehm et al. ..... 299/5
5,725,060 A * 3/1998 Blount et al. ..... 175/61
6,012,516 A * 1/2000 Brunet ..... 166/50
6,041,855 A * 3/2000 Nistor ..... 166/50
6,073,697 A * 6/2000 Parlin et al. ..... 166/313
6,189,616 B1 2/2001 Gano et al.
6,199,633 B1 * 3/2001 Longbottom ..... 166/242.6
6,308,782 B1 * 10/2001 Brooks et al. ..... 166/313
6,536,531 B2 * 3/2003 Brunet ..... 166/380
2002/0056572 A1 * 5/2002 Hanton et al. ..... 175/73
2002/0170713 A1 * 11/2002 Haugen et al. ..... 166/298

* cited by examiner

*Primary Examiner*—David Bagnell
*Assistant Examiner*—Daniel P Stephenson
(74) *Attorney, Agent, or Firm*—Marlin R. Smith

(57) ABSTRACT

A reduced debris milled multilateral window. In a described embodiment, a window joint is constructed in a manner which reduces debris created when a window is milled therethrough. The window joint includes a generally tubular body having a sidewall, a window portion of the sidewall being configured for forming a window therethrough, and a thickness of the sidewall being reduced in the window portion.

34 Claims, 4 Drawing Sheets

REDUCED DEBRIS MILLED MULTILATERAL WINDOW

BACKGROUND

The present invention relates generally to operations performed and equipment utilized in conjunction with subterranean wells and, in an embodiment described herein, more particularly provides a reduced debris milled multilateral window.

In multilateral wells it is common practice to drill a branch or lateral wellbore extending laterally from an intersection with a main or parent wellbore. A casing string is typically installed in the parent wellbore, a whipstock is positioned in the casing string at the desired intersection, and then one or more mills are deflected laterally off of the whipstock to form a window through the casing sidewall.

Unfortunately, this milling process usually produces a large amount of debris, such as small pieces of the metal casing, which accumulate in the parent wellbore. This debris may make the whipstock difficult to retrieve after the milling process is completed. Even after the whipstock is retrieved, the debris may cause other problems, such as plugging flow control devices, damaging seals, obstructing seal bores, interfering with passage of equipment past the intersection, etc.

One proposed solution is to pre-mill the window in the casing, that is, form the window through the casing sidewall prior to installing the casing in the parent wellbore. However, if the casing is to be cemented in the main wellbore, the window should be closed during the cementing operation, such as by using an internal or external sleeve. Typically, the sleeve is made of an easily milled material, such as aluminum or a composite material, or is made so that it can be retrieved after the cementing operation.

Although such sleeves have achieved some success, they also have their problems. For example, the sleeve material may be incompatible with fluids used in the well. The use of an external sleeve increases the casing outer diameter, requiring either a smaller casing size to be used, or a larger wellbore to be drilled. The use of an internal sleeve reduces the casing inner diameter, restricting the passage of fluids and equipment through the casing. The use of a shiftable or retrievable inner sleeve requires another operation in the well and increases the complexity of the equipment and the procedure.

From the foregoing, it can be seen that it would be quite desirable to provide improved apparatus, systems and methods for forming windows in casing.

SUMMARY

In carrying out the principles of the present invention, in accordance with an embodiment thereof, a window joint is provided for interconnection in a casing string. The use of the window joint reduces the debris created when a window is milled through the window joint.

In one aspect of the invention, a window joint is provided which includes a generally tubular body having a sidewall. A window portion of the sidewall is configured for forming a window therethrough. A thickness of the sidewall is reduced in the window portion using a variety of techniques.

In another aspect of the invention, a window joint system is provided which includes a window joint interconnected in a casing string and positioned in a parent wellbore. The window joint includes a sidewall having a window portion through which a window is formed to drill a branch wellbore. The window portion has a reduced thickness of the sidewall prior to forming the window through the window portion.

In yet another aspect of the invention, a method of drilling a branch wellbore extending laterally from an intersection with a parent wellbore is provided. The method includes the steps of: interconnecting a window joint in a casing string, the window joint including a sidewall having a window portion with a reduced thickness of the sidewall; positioning the casing string in the parent wellbore; aligning the window joint with the window portion facing toward the desired branch wellbore; cutting through the window portion of the window joint, thereby forming a window through the sidewall; and drilling the branch wellbore through the window.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
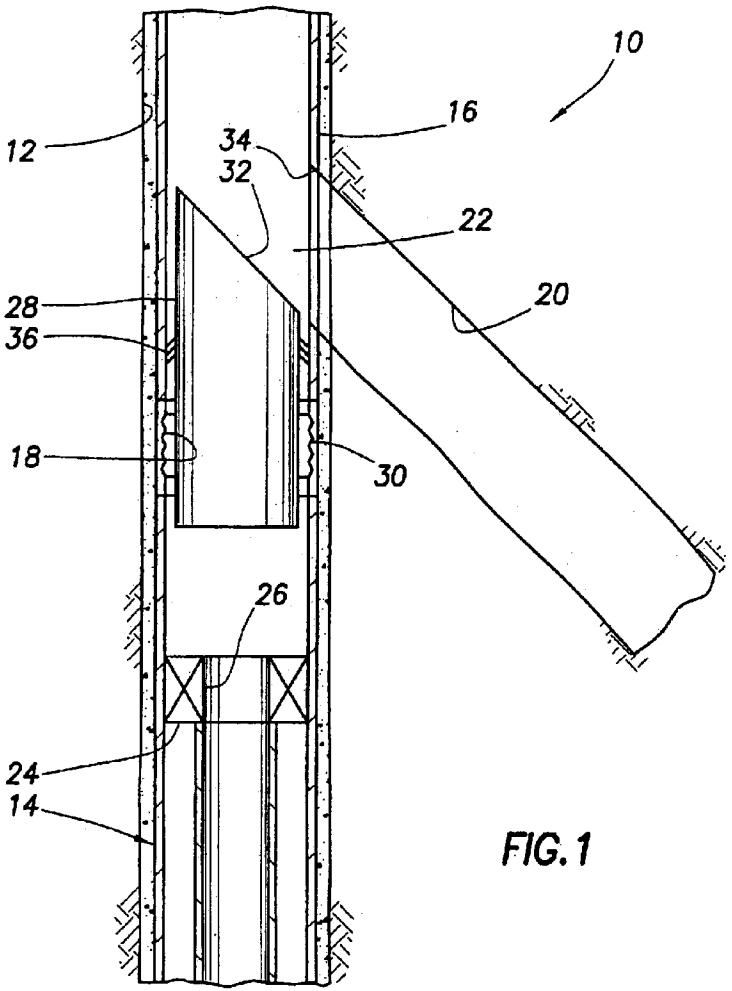
FIG. 1 is a schematic partially cross-sectional view of a method embodying principles of the present invention.

Representatively and schematically illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10, a main or parent wellbore 12 is drilled and a casing string 14 is installed and cemented in the wellbore. The terms "parent" and "main" wellbore are used herein to designate a wellbore from which another wellbore is drilled. A parent or main wellbore does not necessarily extend directly to the earth's surface, but could instead be a branch of yet another wellbore.

The term "casing" is used herein to designate a tubular string used to line a wellbore. Casing may actually be of the type known to those skilled in the art as "liner", and may be made of any material, such as steel or composite material, and may be segmented or continuous, such as coiled tubing.

The casing string 14 in the method 10 includes a window joint 16 interconnected therein. An internal orienting profile 18 may be formed directly on the window joint, or it may be separately attached thereto as depicted in FIG. 1. The window joint 16 is positioned at a desired intersection 22 between the parent wellbore 12 and a branch or lateral wellbore 20 to be drilled later.

The terms "branch" and "lateral" wellbore are used herein to designate a wellbore which is drilled outwardly from its intersection with another wellbore, such as a parent or main wellbore. A branch or lateral wellbore may have another branch or lateral wellbore drilled outwardly therefrom.

The window joint 16 and orienting profile 18 are rotationally oriented relative to the branch wellbore 20 using techniques known to those skilled in the art, such as by using a gyroscope engaged with the orienting profile.

The parent wellbore 12 below the intersection 22 may be completed before or after the branch wellbore 20 is drilled (or not at all). As depicted in FIG. 1, the lower parent wellbore 12 has been completed and has a packer 24 installed therein. The packer 24 includes an internal seal bore or PBR 26.

When it is desired to drill the branch wellbore 20, a whipstock or deflector 28 is positioned in the casing string 14 below the intersection 22. Keys or dogs 30 carried on the whipstock cooperatively engage the orienting profile 18. This engagement anchors the whipstock 28 to the casing string 14 and rotationally orients an inclined deflector surface 32 so that it faces toward the desired branch wellbore 20.

One or more cutting tools, such as mills and drills, are then lowered through the casing string 14 and deflected laterally off of the deflector surface 32 to form a window 34 through the casing and to drill the branch wellbore 20. In prior art methods, this process of forming the window 34 has resulted in a large quantity of debris accumulating in the parent wellbore 12 at and below the intersection 22. Although the whipstock 28 might have been equipped with a debris barrier 36 in these prior art methods, the debris could still hamper retrieval of the whipstock from the well, interfere with passage of equipment through the intersection 22, cut seals (such as packing elements on the packer 24), prevent sealing in seal bores (such as the seal bore 26), or cause other difficulties.

The present invention, however, substantially reduces the debris created in milling the window 34, which reduces or eliminates the problems described above. These advantages are achieved in the method 10 without requiring the use of an internal or external sleeve. Nevertheless, a sleeve could be used in the method 10, if desired, without departing from the principles of the invention.

To achieve these benefits, the window joint 16 used in the method 10 has a reduced thickness sidewall in a window portion of the window joint. This reduced thickness results in less debris being created when the window 34 is milled. Although reduced, the sidewall thickness in the window portion is still sufficient to prevent cement, or other fluids or gases, from flowing therethrough when the casing string 14 is installed and cemented in the parent wellbore 12.

The reduced thickness of the window portion of the window joint 16 makes the sidewall lighter in the window portion, and so the opposite side of the window joint is influenced by gravitational force to seek the lower side of the wellbore 12 when the casing string 14 is installed. The parent wellbore 12 is depicted in FIG. 1 as being substantially vertical, but those skilled in the art understand that this situation is very rare, since most wellbores are actually deviated at least somewhat from true vertical.

Preferably, the branch wellbore 20 is drilled so that it extends at least partially upwardly from the parent wellbore 12. Therefore it is a significant benefit for the side of the window joint 16 opposite the window portion to seek the lower side of the wellbore 12 when the casing string 14 is installed.

Representatively and schematically illustrated in FIGS. 2–8 are various window joints which may be used for the window joint 16 in the method 10. These various specific examples of window joints are described herein to show how the principles of the invention may be incorporated into the construction of window joints, but it is to be clearly understood that the principles of the invention are not limited to the details of these specific examples. Instead, the principles of the invention permit a wide variety of window joint constructions.

In addition, it should be clearly understood that the principles of the invention may be incorporated into methods other than the method 10, such as methods wherein a whipstock is not used. The window joint examples described below, and other window joints embodying principles of the invention, may be used in these other methods, as well.

Figure 2:
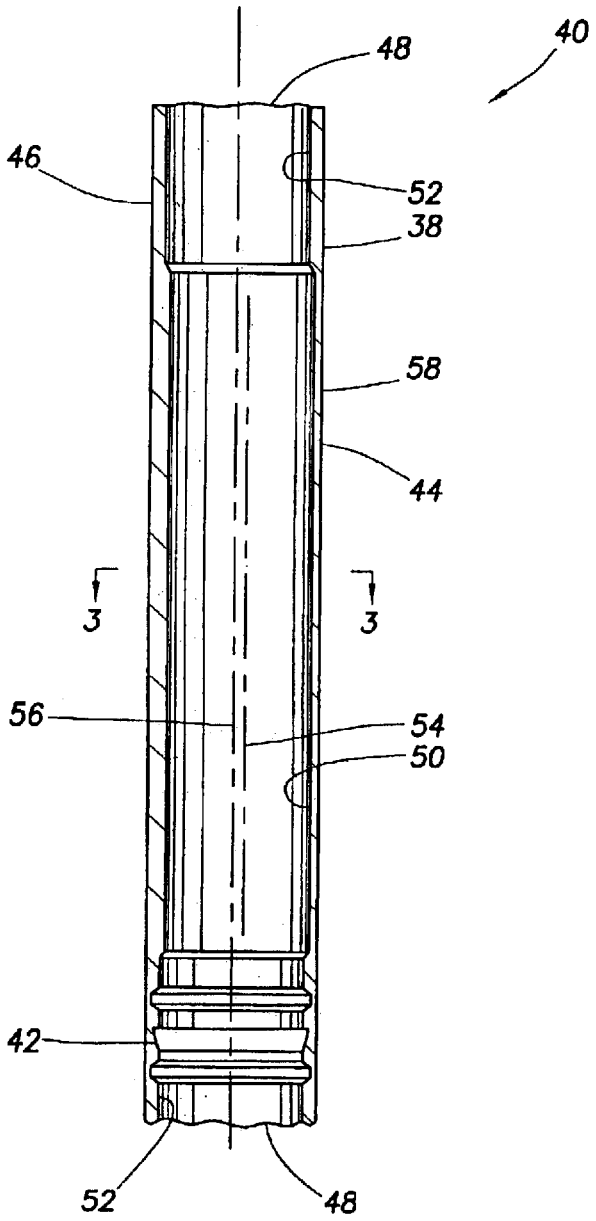
FIG. 2 is a schematic cross-sectional view of a first window joint embodying principles of the invention.
Figure 3:
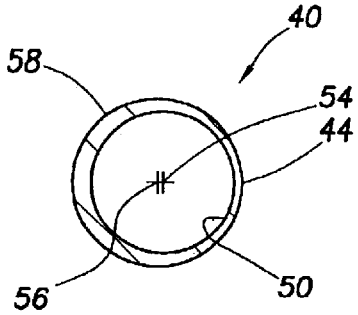
FIG. 3 is a cross-sectional view of the first window joint, taken along line 3—3 of FIG. 2.

In FIGS. 2 & 3 a window joint 40 having an internal orienting profile 42 formed in a tubular body 38 of the window joint is depicted. Preferably, the orienting profile 42 is formed directly on the window joint 40, so that the separate steps of connecting the orienting profile to the window joint and rotationally aligning the profile with the window joint are avoided. However, the orienting profile 42 could be formed in a separate element, such as a collar, if desired.

The window joint 40 has a sidewall 46 that is a consistent thickness at upper and lower end connections 48 of the window joint. The end connections 48 may be provided with conventional threads, seals, seal bores, or welds, etc. (not shown) for interconnection in a tubular string. However, between the end connections 48, the window joint 40 includes a window portion 44 having a reduced sidewall 46 thickness.

This reduced sidewall 46 thickness is formed by laterally offsetting an inner diameter 50 in the window portion 44 relative to inner diameters 52 at the end connections 48. That is, a longitudinal centerline 54 of the window portion 44 is laterally offset relative to a longitudinal centerline 56 of the end connections 48. However, note that the window joint 40 has the same outer diameter 58 at the window portion 44 and at the end connections 48, resulting in the inner diameter 50 being also laterally offset relative to the outer diameter 58.

The offset inner diameter 50 may be formed in the window joint 40 using various methods. For example, the inner diameter 50 may be cut using a lathe, or the window joint could be cast, forged or drawn with the offset inner diameter.

Figure 4:
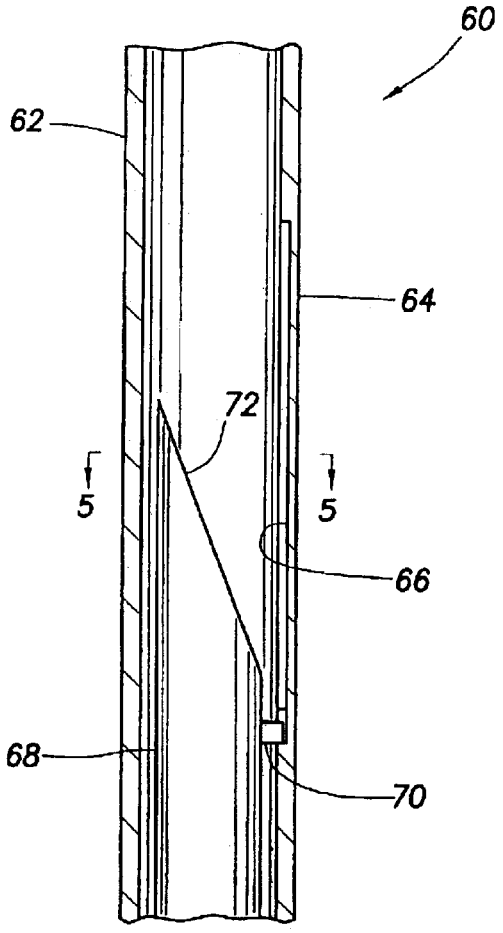
FIG. 4 is a schematic cross-sectional view of a second window joint embodying principles of the invention.
Figure 5:
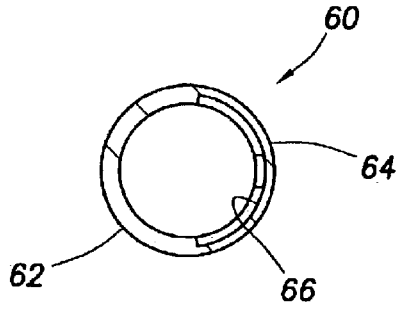
FIG. 5 is a cross-sectional view of the second window joint, taken along line 5—5 of FIG. 4.

In FIGS. 4 & 5 another window joint 60 is depicted. A sidewall 62 of the window joint 60 has a reduced thickness in a window portion 64. The reduced thickness is due to a recess 66 formed internally on the sidewall 62. The recess 66 may be formed by milling, casting, forging, or any other method.

One advantage of using an internally formed recess is that the recess may be used for additional purposes. For example, a whipstock or deflector 68 may carry a member 70 which engages the recess 66 to position and rotationally align a deflector face 72 relative to the window portion 64.

Figure 6:
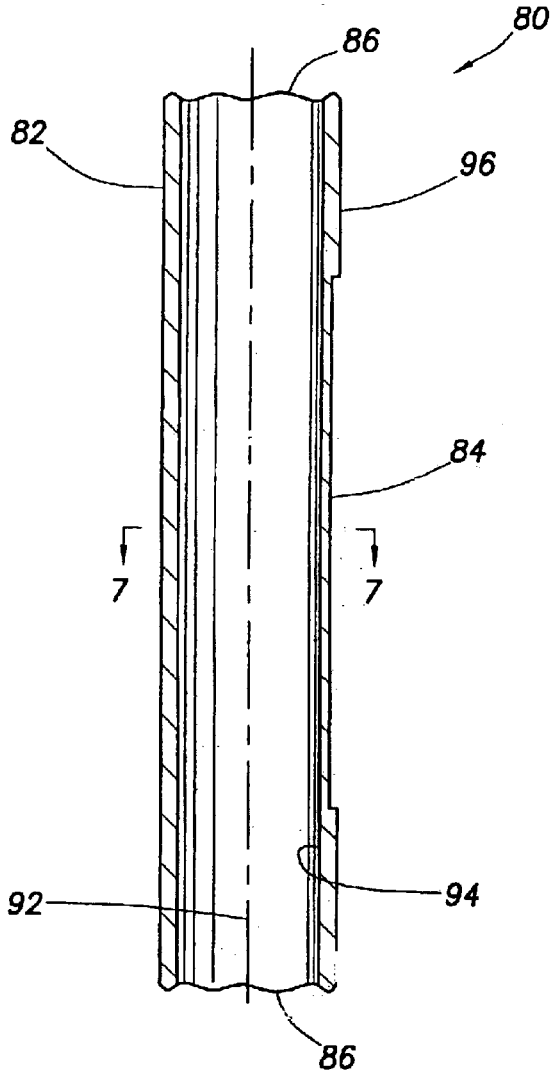
FIG. 6 is a schematic cross-sectional view of a third window joint embodying principles of the invention.
Figure 7A:
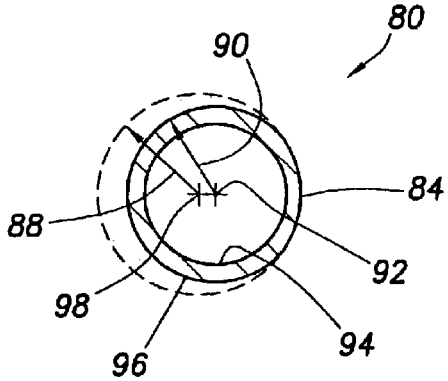
FIGS. 7A & B are alternate cross-sectional views of the third window joint, taken along line 7—7 of FIG. 6.

In FIGS. 6, 7A & B another window joint 80 is depicted. The window joint 80 has a sidewall 82 with a reduced thickness in a window portion 84 between end connections 86. The window joint 80 can also include an orienting profile, such as the profile 42 described above, and can also include one or more internal recesses, such as the recess 66 described above, formed on the window portion 84.

The cross-sectional views in FIGS. 7A & B depict alternate methods of forming the reduced sidewall thickness in the window portion 84. In FIG. 7A, the reduced thickness is formed by cutting (or casting, forging, drawing, etc.) a laterally offset, but larger radius 88 on an outer radius go of the window joint 80. The radius go has a longitudinal centerline 92, which also corresponds to inner and outer diameters 94, 96 of the window joint 80. However, a centerline 98 of the radius 88 is laterally offset relative to the centerline 92.

Thus, the window portion 84 includes multiple intersecting external radii 88, 90. One benefit of this construction is that the sidewall thickness of the window portion 84 gradually increases to either side between the radius 88 and the inner diameter 94 in the window portion, providing increased support against collapse of the window portion.

Although the window joint 80 as depicted in FIG. 7A has the radius 88 greater than the radius go, it should be understood that the radii could be the same, or the radius 88 could be smaller than the radius 90.

Figure 7B:
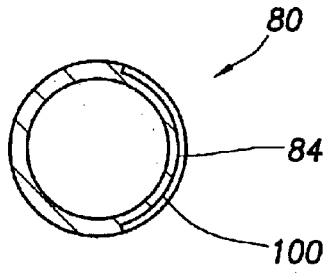

In FIG. 7B the window joint 80 is depicted with the reduced sidewall thickness being due to a recess 100 formed externally on the window portion 84. The recess 100 may be formed by milling, casting, forging, or any other method. Note that any shape of the recess 100 may be used in keeping with the principles of the invention.

For example, instead of the recess 100 being curved about the circumference of the sidewall 82, as depicted in FIG. 7B, the recess could be straight, etc. Although the recess 100 is depicted in FIG. 7B as extending only a portion of the length of the window joint 80, the recess could extend the entire length of the window joint.

Figure 8:
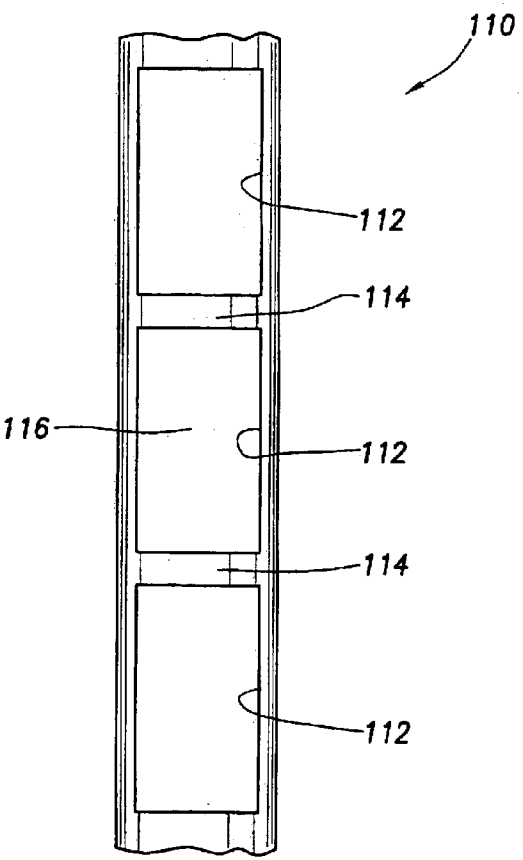
FIG. 8 is an elevational side view of a fourth window joint embodying principles of the invention.

In FIG. 8 another window joint 110 is depicted which is similar to the window joint 80. However, the window joint 110 includes a window portion 116 having multiple recesses 112 formed externally thereon. Between the recesses 112, circumferentially extending ribs 114 are disposed to support the reduced sidewall thickness resulting from the recesses.

The window joint 110 may alternatively, or in addition, have one or more recesses formed internally thereon, such as the recess 66 described above, and if multiple internal recesses are used, supporting ribs may be formed between the internal recesses.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A window joint, comprising:

a generally tubular body having a sidewall, a window portion of the sidewall being configured for forming a window therethrough, and a thickness of the sidewall being reduced in the window portion, and the window portion having multiple recesses formed in the sidewall, the sidewall between the recesses forming at least one supporting rib.

2. The window joint according to claim 1, wherein the body further has an orienting profile formed internally therein.

3. The window joint according to claim 2, wherein the orienting profile is rotationally aligned with the window portion of the sidewall.

4. The window joint according to claim 1, wherein the window portion has an outer diameter laterally offset relative to an inner diameter of the window portion.

5. The window joint according to claim 1, wherein the window portion has an inner diameter with a longitudinal centerline laterally offset relative to a longitudinal centerline of end connections of the window joint.

6. The window joint according to claim 1, wherein the window portion has the recesses formed externally on the body sidewall to reduce the thickness of the sidewall.

7. The window joint according to claim 1, wherein the window portion has the recesses formed internally on the body sidewall to reduce the thickness of the sidewall.

8. The window joint according to claim 1, wherein the window portion has an external radius formed thereon which reduces the thickness of the sidewall.

9. The window joint according to claim 1, wherein the window portion has multiple radii formed externally thereon.

10. The window joint according to claim 1, wherein the rib extends circumferentially on the window portion.

11. A window joint system, comprising:

a window joint interconnected in a casing string positioned in a first wellbore, the window joint including a sidewall having a window portion through which a window is formed to drill a second wellbore, the window portion having a reduced thickness of the sidewall prior to forming the window through the window portion, and the window portion having multiple recesses formed in the sidewall, the sidewall between the recesses forming at least one supporting rib.

12. The window joint system according to claim 11, wherein the window portion has a reduced weight, so that the window portion is oriented upwardly relative to the first wellbore.

13. The window joint system according to claim 11, wherein the window portion has an inner diameter centerline which is in line with an inner diameter centerline of end connections of the window joint.

14. The window joint system according to claim 11, wherein the window portion has an inner diameter centerline which is laterally offset relative to an inner diameter centerline of end connections of the window joint.

15. The window joint system according to claim 11, wherein the window joint further has an orienting profile formed internally therein.

16. The window joint system according to claim 15, wherein the orienting profile is rotationally aligned with the window portion of the sidewall.

17. The window joint system according to claim 11, wherein the window portion has an outer diameter laterally offset relative to an inner diameter of the window portion.

18. The window joint system according to claim 11, wherein the window portion has the recesses formed externally on the sidewall to reduce the thickness of the sidewall.

19. The window joint system according to claim 11, wherein the window portion has the recesses formed internally on the sidewall to reduce the thickness of the sidewall.

20. The window joint system according to claim 11, wherein the window portion has an external radius formed thereon which reduces the thickness of the sidewall.

21. The window joint system according to claim 11, wherein the window portion has multiple radii formed externally thereon.

22. The window joint system according to claim 11, wherein the rib extends circumferentially on the window portion.

23. A method of drilling a branch wellbore extending laterally from an intersection with a parent wellbore, the method comprising the steps of:

interconnecting a window joint in a casing string, the window joint including a sidewall having a window portion with a reduced thickness of the sidewall;

positioning the casing string in the parent wellbore;

aligning the window joint with the window portion facing toward the desired branch wellbore, the aligning step including rotationally orienting the window portion at least partially upwardly in the parent wellbore as a result of reduced gravitational force exerted on the reduced thickness sidewall of the window portion;

cutting through the window portion of the window joint, thereby forming a window through the sidewall; and drilling the branch wellbore through the window.

24. The method according to claim 23, further comprising the step of reducing the sidewall thickness in the window portion by laterally offsetting an inner diameter of the window portion relative to an outer diameter of the window portion.

25. The method according to claim 23, further comprising the step of reducing the sidewall thickness in the window portion by laterally offsetting an inner diameter of the window portion relative to inner diameters of end connections of the window joint.

26. The method according to claim 23, further comprising the step of reducing the sidewall thickness in the window portion by forming at least one recess on the window portion.

27. The method according to claim 26, wherein the forming step further comprises forming the recess externally on the window portion sidewall.

28. The method according to claim 26, wherein the forming step further comprises forming the recess internally on the window portion sidewall.

29. The method according to claim 26, wherein the forming step further comprises forming at least one of the recesses internally and at least one of the recesses externally on the window portion sidewall.

30. The method according to claim 25 further comprising the step of reducing the sidewall thickness in the window portion by forming a radius externally on the window portion.

31. The method according to claim 23, wherein the window joint includes an orienting profile formed therein, and further comprising the step of rotationally orienting the profile relative to the window portion.

32. The method according to claim 31, wherein the cutting step further comprises engaging a deflector with the orienting profile, thereby rotationally aligning a deflector surface of the deflector with the window portion.

33. A method of drilling a branch wellbore extending laterally from an intersection with a parent wellbore, the method comprising the steps of:

interconnecting a window joint in a casing string, the window joint including a sidewall having a window portion with a reduced thickness of the sidewall;

reducing the sidewall thickness in the window portion by forming multiple recesses on the window portion, and forming supporting ribs in the sidewall between the recesses;

positioning the casing string in the parent wellbore;

aligning the window joint with the window portion facing toward the desired branch wellbore;

cutting through the window portion of the window joint, thereby forming a window through the sidewall; and drilling the branch wellbore through the window.

34. A method of drilling a branch wellbore extending laterally from an intersection with a parent wellbore, the method comprising the steps of:

interconnecting a window joint in a casing string, the window joint including a sidewall having a window portion with a reduced thickness of the sidewall;

reducing the sidewall thickness in the window portion by forming a radius externally on the window portion, the radius intersecting an outer diameter of the window portion;

positioning the casing string in the parent wellbore;

aligning the window joint with the window portion facing toward the desired branch wellbore;

cutting through the window portion of the window joint, thereby forming a window through the sidewall; and drilling the branch wellbore through the window.

* * * * *